US007091438B2

(12) United States Patent
Shea et al.

(10) Patent No.: US 7,091,438 B2
(45) Date of Patent: Aug. 15, 2006

(54) CIRCUIT BREAKER WITH IMPROVED ARC EXTINCTION SYSTEM

(75) Inventors: John Joseph Shea, Pittsburgh, PA (US); Paul Richard Rakus, Beaver Falls, PA (US); Thomas Clements Pendrick, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/035,310

(22) Filed: Jan. 13, 2005

(65) Prior Publication Data

US 2006/0151439 A1 Jul. 13, 2006

(51) Int. Cl.
*H01H 33/02* (2006.01)

(52) U.S. Cl. ..... 218/34; 218/149

(58) Field of Classification Search ..... 218/34–42, 218/14, 15, 46, 47, 76, 77, 148, 149, 153–157; 335/201–204

See application file for complete search history.

(56) References Cited

U.S. PATENT DOCUMENTS 4,654,491 A * 3/1987 Maier et al. ..... 218/33
4,748,301 A * 5/1988 Goldman et al. ..... 218/150
4,752,660 A * 6/1988 Yokoyama et al. ..... 218/117
5,247,142 A 9/1993 Yonkovitz et al.
5,927,484 A * 7/1999 Malingowski et al. ..... 200/401
6,060,674 A * 5/2000 Malingowski et al. ..... 200/272
6,281,459 B1 * 8/2001 Munsch et al. ..... 218/22

* cited by examiner

*Primary Examiner*—Elvin Enad
*Assistant Examiner*—M. Fishman
(74) *Attorney, Agent, or Firm*—Martin J. Moran

(57) ABSTRACT

An improved circuit breaker includes an arc extinction system having one or more insulators that generates a desirable gas in the presence of an arc. The exemplary circuit breaker includes gas-generating insulators disposed at three sides of a stationary contact and an arc chute at a fourth side of the stationary contact. The gas promotes the desirable extinction of the arc in a number of exemplary fashions. The presence of the gas on three sides of the stationary contact can resist movement of the arc toward the gas, thereby substantially limiting movement of the arc in a direction other than toward the arc chute. The gas can remove heat from the arc, thereby promoting deionization of the plasma by forming neutral molecular species at a lower temperature state. The presence of the gas can reduce the concentration of ions and electrons within the interior of the circuit breaker and can increase the pressure within the circuit breaker, and these also facilitate extinction of the arc.

14 Claims, 5 Drawing Sheets

CIRCUIT BREAKER WITH IMPROVED ARC EXTINCTION SYSTEM

BACKGROUND OF THE INVENTION

1. Field of the Invention

The invention relates generally to circuit breakers and, more particularly, to a circuit breaker having an improved arc extinction system that provides a gas in the presence of an arc.

2. Description of the Related Art

Circuit breakers are generally well known and are used in numerous applications. Circuit breakers can be used to interrupt a circuit under certain predetermined circumstances, and can be used for other purposes.

A typical circuit breaker might include a set of separable contacts that can be separated in certain predetermined circumstances to open a circuit. The separable contacts might include one or more movable contacts that are disposed on a movable arm which, when moved, can separate the one or more movable contacts from one or more stationary contacts to interrupt the circuit. As the movable contacts begin to move away from the stationary contacts, an electrical arc oftentimes forms between the movable contacts and the stationary contacts. The electrical arc is desired to be extinguished as soon as possible for various reasons that are well understood in the relevant art. The circuit breaker may, for example, include an arc chute having a plurality of spaced apart arc plates which help to dissipate and break up an arc when the arc is received in the arc chute. While such circuit breakers have been generally effective for their intended purposes, such circuit breakers have not, however, been without limitation.

Depending upon the magnitude of current, an electrical arc can have a temperature in the range of about 3000°K to 30,000°K, with the relatively highest temperature of the arc being at approximately its center. Such electrical arcs have a tendency to vaporize material within the interior of the circuit breaker. Certain vaporized materials can generate airborne ions that help to form a high temperature plasma that undesirably can encourage the continued existence of an electrical arc. It thus would be desirable to provide an improved circuit breaker that has an improved ability to extinguish an electrical arc.

SUMMARY OF THE INVENTION

An improved circuit breaker includes an arc extinction system having one or more insulators that generate a desirable gas in the presence of an arc. The exemplary circuit breaker includes gas-generating insulators disposed at three sides of a stationary contact and an arc chute at a fourth side of the stationary contact. The gas promotes the desirable extinction of the arc in a number of exemplary fashions. The presence of the gas on three sides of the stationary contact can resist movement of the arc toward the gas, thereby substantially limiting movement of the arc in a direction other than toward the arc chute. The gas can remove heat from the arc, thereby promoting deionization of the plasma by forming neutral molecular species at a lower temperature state. The presence of the gas can reduce the concentration of ions and electrons within the interior of the circuit breaker and can increase the pressure within the circuit breaker, and these also facilitate extinction of the arc.

Accordingly, an aspect of the invention is to provide an improved circuit breaker having an improved arc extinction system.

Another aspect of the invention is to provide an improved circuit breaker having an arc extinction system that includes insulators that generate a gas in the presence of an arc.

Another aspect of the invention is to provide an improved circuit breaker having an arc extinction system that resists movement of an arc in directions other than toward an arc chute.

Another aspect of the invention is to provide an improved circuit breaker having insulators that provide a gas in the presence of an arc to reduce the temperature of the arc.

Another aspect of the invention is to provide an improved circuit breaker having insulators that generate a gas in the presence of an arc and that are positioned to promote movement of the arc in a direction toward an arc chute.

Accordingly, an aspect of the invention is to provide an improved circuit breaker, the general nature of which can be stated as including a first conductor, a second conductor, a set of contacts, and an arc extinction system. The first conductor includes an elongated portion, and the second conductor includes a movable arm. The set of contacts includes at least a first stationary contact and at least a first movable contact, the at least a first movable contact and the at least a first stationary contact are separable to interrupt a circuit that includes the first and second conductors. The at least a first stationary contact is disposed on the first conductor, and the at least a first movable contact is disposed on the movable arm. The arc extinction system includes at least a first insulator disposed adjacent the at least a first stationary contact. The at least a first insulator is structured to output a gas upon an initiation of an arc between the at least a first stationary contact and the at least a first movable contact to resist movement of the arc in a direction generally toward the at least a first insulator. The elongated portion extends adjacent at least a portion of the movable arm to form a reverse loop with the at least a portion of the movable arm. At least a portion of the at least a first insulator is disposed between at least a portion of the elongated portion of the first conductor and the at least a portion of the movable arm.

Another aspect of the invention is to provide an improved circuit breaker, the general nature of which can be stated as including a first conductor, a second conductor, a set of contacts, and an arc extinction system. The second conductor includes a movable arm. The set of contacts includes at least a first stationary contact and at least a first movable contact, with the at least a first movable contact and the at least a first stationary contact being separable to interrupt a circuit that includes the first and second conductors. The at least a first stationary contact is disposed on the first conductor, and the at least a first movable contact is disposed on the movable arm. The arc extinction system includes a first insulator and a second insulator disposed adjacent and at alternate sides of the at least a first stationary contact. The first insulator is structured to output a gas upon an initiation of an arc between the at least a first stationary contact and the at least a first movable contact to resist movement of the arc in a direction generally toward the first insulator. The second insulator is structured to output a gas upon an initiation of an arc between the at least a first stationary contact and the at least a first movable contact to resist movement of the arc in a direction generally toward the second insulator.

Another aspect of the invention is to provide an improved circuit breaker, the general nature of which can be stated as including a first conductor, a second conductor, a set of contacts, and an arc extinction system. The second conductor includes a movable arm. The set of contacts includes at least a first stationary contact and at least a first movable contact, with the at least a first movable contact and the at least a first stationary contact being separable to interrupt a circuit that includes the first and second conductors. The at least a first stationary contact is disposed on the first conductor, and the at least a first movable contact is disposed on the movable arm. The arc extinction system includes an arc chute and at least a first insulator. The at least a first insulator is disposed adjacent the at least a first stationary contact and is structured to output a gas upon an initiation of an arc between the at least a first stationary contact and the at least a first movable contact to resist movement of the arc in a direction generally toward the at least a first insulator. At least a portion of the at least a first stationary contact is disposed generally between at least a portion of the at least a first insulator and at least a portion of the arc chute.

BRIEF DESCRIPTION OF THE DRAWINGS

A further understanding of the invention can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
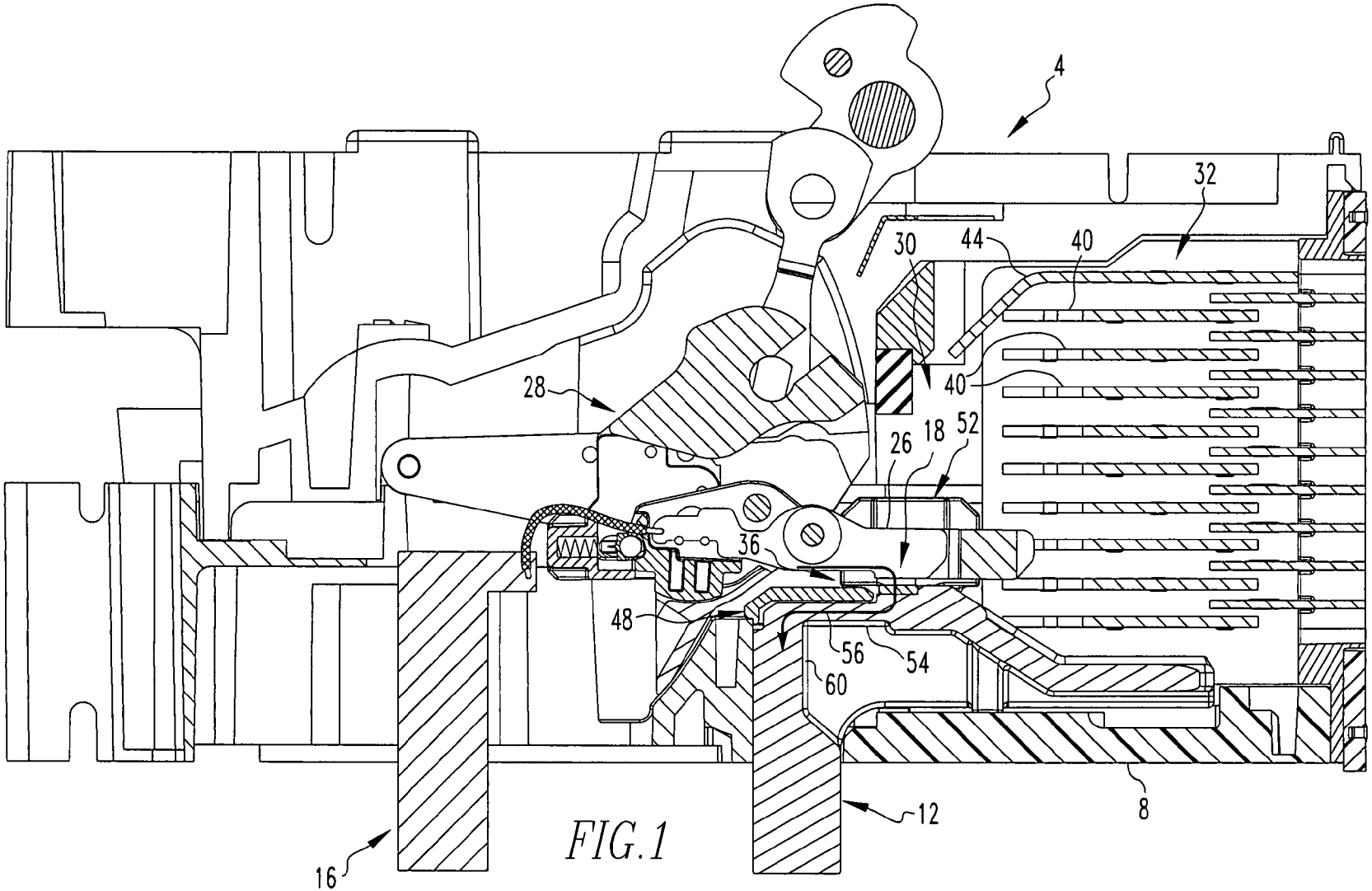
FIG. 1 is a cut away side view of a pole of a circuit breaker in accordance with the invention.
Figure 2:
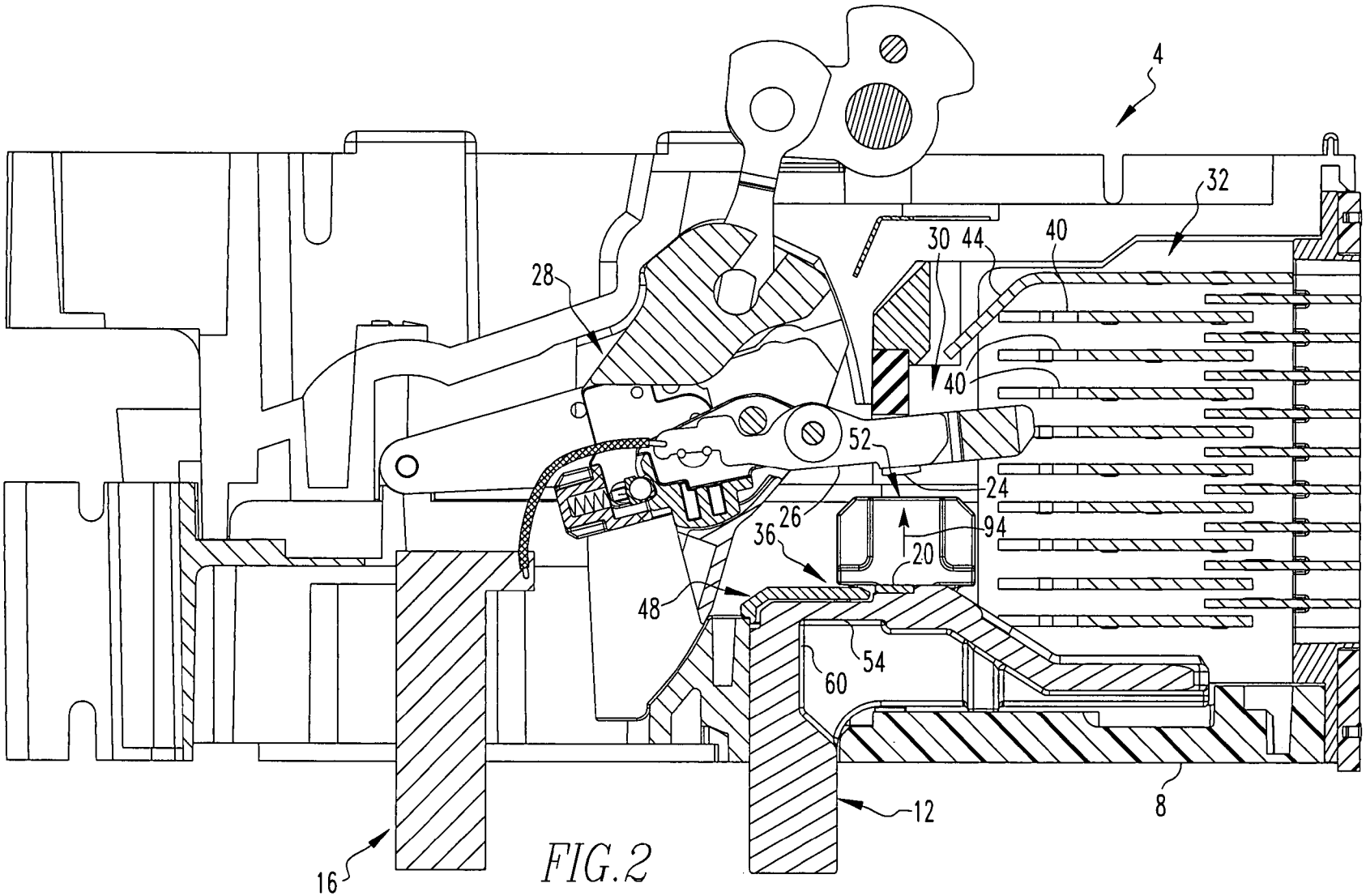
FIG. 2 is another view of the pole of the circuit breaker of FIG. 1.
Figure 3:
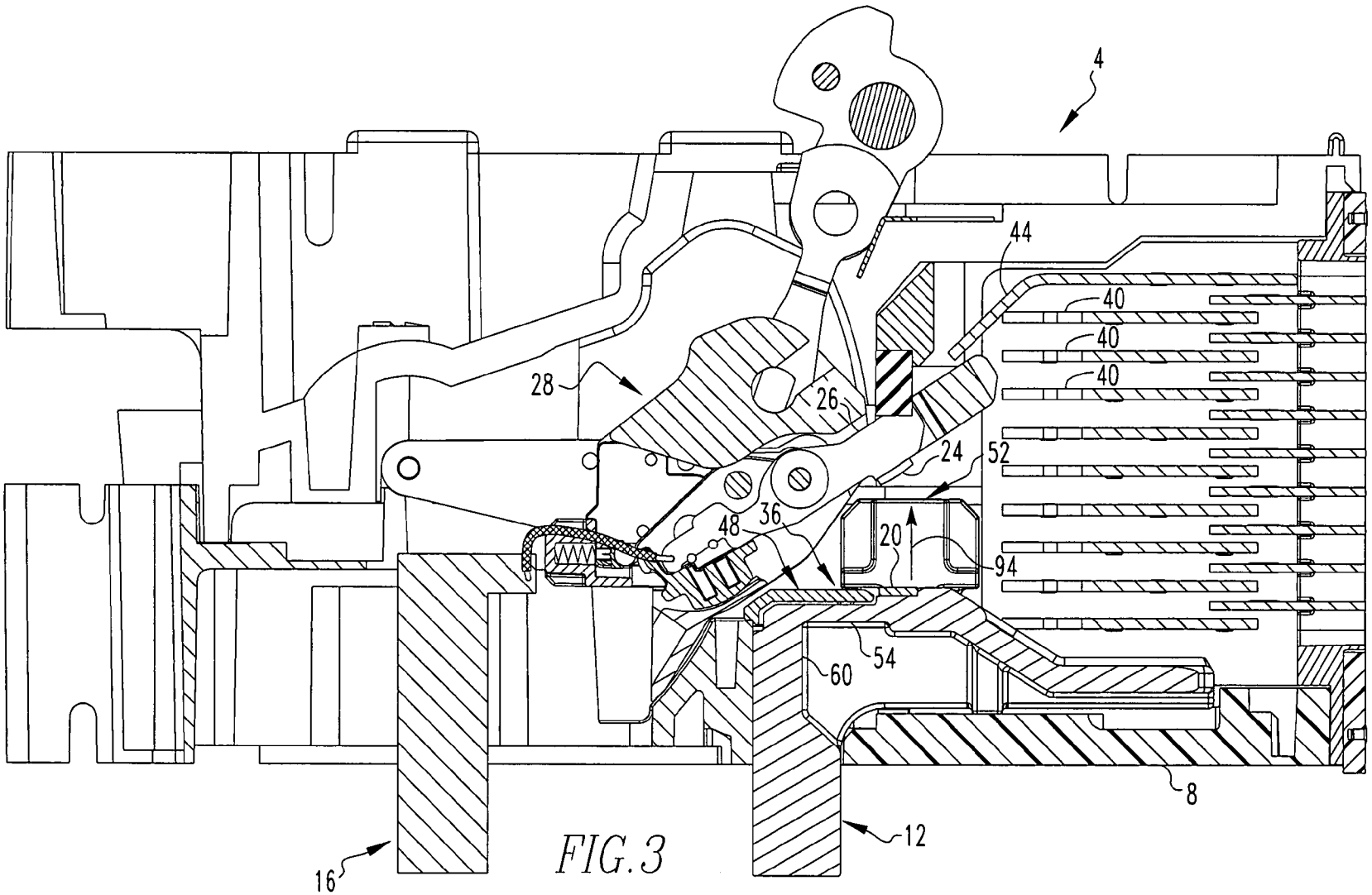
FIG. 3 is another view of the pole of the circuit breaker of FIG. 1.

An improved circuit breaker 4 in accordance with the invention is indicated in a cut away fashion FIGS. 1–3. While FIGS. 1–3 depict a single pole of the circuit breaker 4, it is understood that the circuit breaker 4 may, for example, be a multi-pole circuit breaker that includes a plurality of the depicted poles connected together in an understood fashion.

The circuit breaker 4 can be generally stated as including a case 8, a line conductor 12, a load conductor 16, and a set of contacts 18. The set of contacts 18 includes a stationary contact 20 and a movable contact 24 that are separable from one another in one or more predetermined circumstances to open a circuit that includes the circuit breaker 4.

The movable contact 24 is disposed on a movable arm 26 of the load conductor 16, and the movable arm 26 is disposed on a moving contact assembly 28. Movement of the movable arm 26 causes the movable contact 24 to be separated from the stationary contact 20.

The circuit breaker 4 additionally includes an arc extinction system 30 that advantageously promotes the rapid extinction of an electrical arc between the stationary contact 20 and the moving contact 24 during separation thereof. The arc extinction system 30 includes an arc chute 32 and an insulator apparatus 36. The arc chute 32 includes a plurality of spaced apart arc plates 40 and an arc horn 44. The arc plates 40 tend to break up and dissipate an arc that has entered the arc chute 32, and the arc horn 44 promotes movement of the arc into the arc chute 32.

The insulator apparatus 36 includes an end insulator 48 and a pair of side insulators 52 that are advantageously configured to generate a gas in the presence of an arc, such as an arc between the stationary contact 20 and the movable contact 24 during separation thereof. In the present exemplary embodiment, the gas generated by the end and side insulators 48 and 52 is a mixture of gases including, for example, hydrogen gas ($H_2$), carbon monoxide (CO), carbon dioxide ($CO_2$), oxides of nitrogen ($NO_x$), methane ($CH_4$), ethane ($C_2H_6$), acetylene ($C_2H_2$), ethylene ($C_2H_4$), and/or other hydrocarbon species and/or other gases. The insulator apparatus of other embodiments (not shown) can be configured to additionally or alternatively generate ions from elements such as, for example and without limitation, fluorine (F), chlorine (Cl), and bromine (Br). The generation of such a gas in the presence of an arc advantageously promotes extinction of the arc in a fashion set forth more fully below.

The circuit breaker 4 is movable between an ON position, such as is depicted generally in FIG. 1, and a TRIPPED position, as is generally indicated in FIG. 2. The set of contact 18 are separated when in the TRIPPED position.

In the present exemplary embodiment of the circuit breaker 4, the line conductor 12 includes an elongated portion 54 that extends generally parallel with and adjacent at least a portion of the movable arm 26 to form a reverse loop therebetween, as is indicated generally by the arrow 56 of FIG. 1. During certain overcurrent conditions, magnetic repulsion forces between the elongated portion 54 and the movable arm 26 can be of sufficient magnitude to force the movable arm 26 to pivot away from the elongated portion 54 in a blow-open fashion to separate the set of contacts 18. This situation is depicted generally in FIG. 3. Such a feature can be provided to separate the movable contact 24 and the stationary contact 20 in an extremely rapid fashion. Shortly after the blow-open feature forces the movable arm 26 away from the elongated portion 54, the remaining portions of the moving contact assembly 28 catch up with the movable arm 26 to place the circuit breaker generally in the TRIPPED position of FIG. 2. It is understood that in other embodiments of the invention (not shown), the circuit breaker 4 can be configured to not include the reverse loop 56 without departing from the concept of the invention.

Figure 4:
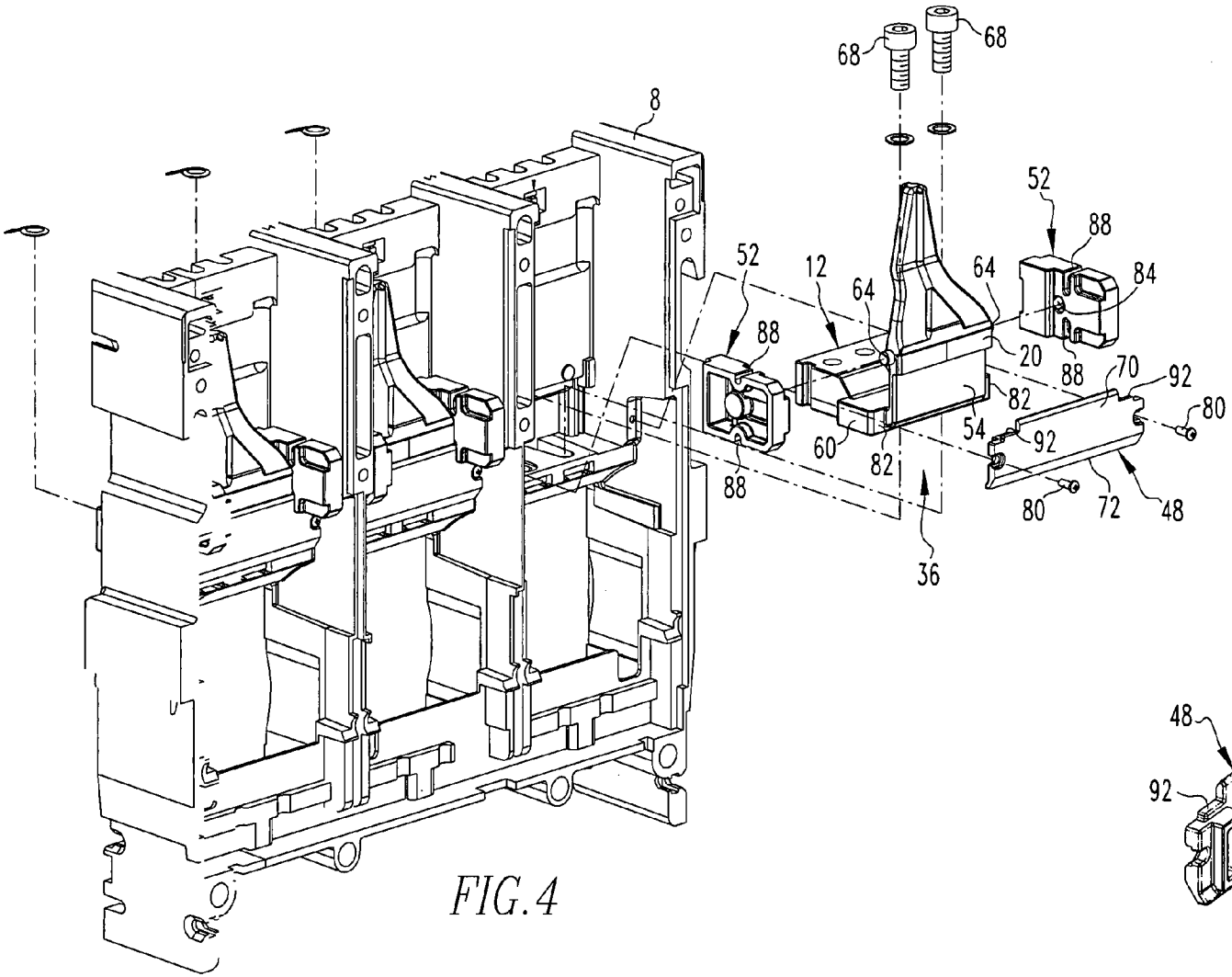
FIG. 4 is a partially exploded isometric view of a portion of the circuit breaker of FIG. 1.

As can be seen in FIG. 4, the line conductor 12 additionally includes a transverse portion 60 that extends from the elongated portion 54 in a direction generally transverse to the elongated portion 54. The line conductor 12 also includes a pair of outwardly-protruding bosses 64 that are disposed generally on opposite sides of the stationary contact 20.

The stationary contact 20 is disposed on the line conductor 12. The line conductor 12 is mounted to the case 8 with a pair of screws 68.

In the present exemplary embodiment, the end insulator 48 and the side insulators 52 are formed of a cellulose filled melamine formaldehyde, which is a thermosetting resin that provides good gassing properties and an ability to withstand high arc temperatures without compromising its dielectric integrity. It is noted that numerous other materials may be employed to form the end and side insulators 48 and 52 such as, for example, glass filled polyester with alumina trihydrate (such as Rosite 3550D made by Rostone), glass filled and impact modified polyamide (such as Nylon 6/6), polyoxymethylene (Delrin made by Du Pont), polytetrafluoroethylene (Teflon made by Du Pont), vulcanized fiber papers (such as Fishpaper), and/or other thermosetting base resins with an appropriate arc quenching filler (e.g. ATH). The materials could, for example, be glass filled to improve mechanical stability. It is understood that these and/or other materials can be employed without limitation.

Figure 5:
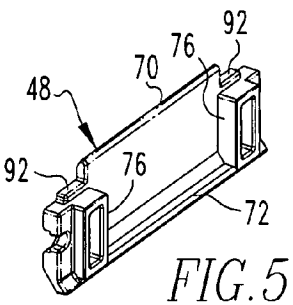
FIG. 5 is an isometric view of a portion of the circuit breaker of FIG. 1.

As can be understood from FIGS. 4 and 5, the end insulator 48 includes a plate portion 70 and a transverse extension 72. The end insulator 48 additionally includes a pair of supports 76 disposed on the plate portion 70. The end insulator 48 is mounted within the circuit breaker 4 by a pair of the screws 80 that, for example, are threaded into the case 8. When assembled, the supports 76 are disposed on a mounting surface 28 of the line conductor 12. The plate portion 70 extends along the elongated portion 54 of the line conductor 12 and, as can be seen in FIG. 1, is disposed between the elongated portion 54 and the movable arm 26. The transverse extension 72 of the end insulator 48 wraps around the transition between the elongated portion 54 and the transverse portion 60 of the line conductor 12, and additionally extends along at least a portion of the transverse portion 60.

As can further be seen from FIG. 4, the side insulators 52 each include a recessed region 84. The bosses 64 are engaged with the recessed regions 84 of the side insulators 52 to help retain the side insulators 52 adjacent and at opposite sides of the stationary contact 20, as is indicated generally in FIG. 4. Each side insulator 52 additionally includes a pair of receptacles 88 that are positioned in a mirror image fashion with respect to the recessed region 84. One of the receptacles 88 of each side insulator 52 is engaged by a cut-out region 92 of the plate portion 70 of the end insulator 48. In the present exemplary embodiment, the side insulators 52 are substantially identical to one another to save tooling costs. One of the receptacles 88 is engaged by one of the cut-out regions 92 regardless of at which side of the line conductor 12 the side insulator 52 is disposed.

Figure 6:
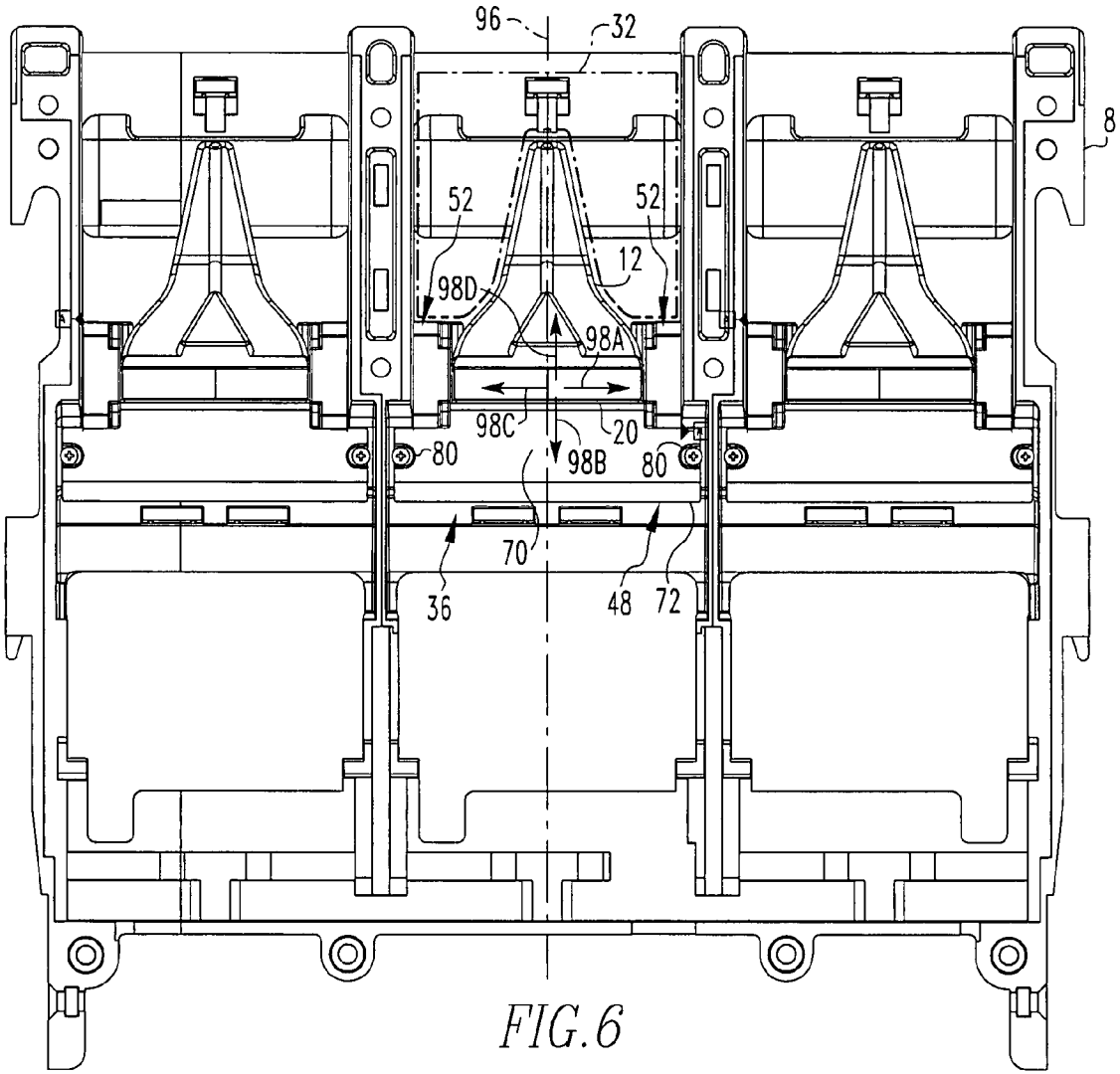
FIG. 6 is a top plan view of a portion of the circuit breaker of FIG. 1.

As can be understood from FIGS. 4 and 6, the end insulator 48 is disposed adjacent the stationary contact 20 and additionally extends generally between the side insulators 52. The side insulators 52 can therefore be said to be disposed adjacent and at alternate sides of the end insulator 48. As can be best understood from FIG. 6, each pole of the circuit breaker 4 can be said to include a main axis 96 that extends generally along the stationary contact 20 and the arc chute 32. It is noted that an outline of the arc chute 32 is shown in broken lines in FIG. 6 for purposes of clarity. Any arc which forms between the stationary contact 20 and the movable contact 24 desirably moves in a direction generally along the main axis 96 in a direction from the stationary contact 20 generally toward the arc chute 32 to enable the arc plates 40 to break up and dissipate the arc. The end insulator 48 is generally centered on the main axis 96 and is positioned adjacent the stationary contact 20 such that the stationary contact 20 is disposed generally between the end insulator 48 and the arc chute 32. Additionally, the side insulators 52 are disposed on alternate sides of the main axis 96 and are disposed adjacent the stationary contact 20 at alternate sides thereof. It thus can be seen that upon initiation of an arc between the stationary contact 20 and the movable contact 24, the end and side insulators 48 and 52 generate gases on three sides of the stationary contact 20. A fourth side of the stationary contact 20 is generally open and faces toward the arc chute 32. That is, and as can be seen in an exemplary fashion in FIG. 6, movement of an arc in any of the mutually orthogonal directions 98A, 98B, and 98C is resisted by the hydrogen gas, thus permitting movement of the arc generally only in the direction 98D, i.e., generally toward the arc chute 32.

In the presence of an arc, the material of the end and side insulators 48 and 52 is vaporized by the arc and, in the present example, generates gases such as hydrogen gas ($H_2$), carbon monoxide (CO), carbon dioxide ($CO_2$), oxides of nitrogen ($NO_x$), methane ($CH_4$), ethane ($C_2H_6$), acetylene ($C_2H_2$), ethylene ($C_2H_4$), and/or other hydrocarbon species and/or other gases. When considering gases, hydrogen gas is a very good thermal conductor at typical arc extinction temperatures such as, for example, in the range of about 2500°K to 5000°K. The hydrogen gas conducts heat away from the arc to structures such as the case 8 and/or other structures of the circuit breaker 4. Since the hydrogen gas is generated substantially adjacent the arc, the conduction of heat away from the arc by the hydrogen gas has a tendency to cool the arc with resultant deionization of the plasma in the vicinity of the arc due to recombination of ions and electrons into neutral molecular species at a lower temperature state. Such reduction in the plasma temperature adjacent the arc promotes extinction of the arc. Also, the presence of the generated gases increases the ambient pressure within the circuit breaker 4. This tends to increase the arc voltage, subsequently reducing peak current, thus reducing the arc temperature. This likewise has a tendency to extinguish the arc. Moreover, the hydrogen gas has a relatively high dielectric breakdown strength, and this resists movement of the arc in directions other than toward the arc chute 32.

The gas generated adjacent the stationary contact 20 promotes movement of the arc in a direction generally toward the arc chute 32. In the present exemplary embodiment, the end and side insulators 48 and 52 are configured and positioned to provide gassing at three sides of the stationary contact 20 from the perspective of FIG. 6. Such gassing at three sides of the stationary contact 20 resists movement of the arc in a direction generally toward any of those three sides, thereby limiting movement of the arc to permit movement generally only in a direction toward the fourth side, i.e., in a direction generally toward the arc chute 32 where the arc will be broken up and dissipated. Such gassing at three sides of the stationary contact 20 also generates a pressure gradient at three sides of the stationary contact 20 which has the effect of pushing the arc toward the arc chute 32. These have the effect of promoting rapid extinction of the arc.

As can be understood from FIGS. 2 and 3, when the movable contact 24 is moved away from the stationary contact 20, whether or not in a blow-open fashion, the movable contact 24 can be generally said to move in a first direction away from the stationary contact 20, as is indicated generally by the arrow 94 in FIGS. 2 and 3. As the movable contact 24 moves away from stationary contact 20, an arc (not shown) formed therebetween can lie generally along the first direction 94. In this regard, the side insulators 52 advantageously are elongated and extend beyond the stationary contact 20 along the first direction 94. Since an arc tends to vaporize portions of the material out of which the end and side insulators 48 and 52 are manufactured, the extending of the side insulators 52 generally along the direction where an arc will propagate increases the quantity of material of the insulator apparatus 36 that is available to produce the gases in the presence of an arc. This has a tendency to increase the rate of production of hydrogen gas, thereby facilitating extinction of the arc.

As can be understood from FIG. 3, when the movable arm 26 is moved away from the elongated portion 54 of the line conductor 12 in a blow-open fashion, a portion of the movable arm 26 can be pivoted relatively close to the line conductor 12. In order to resist the propagation of an arc between the line conductor 12 and the movable arm 26, and/or to resist movement of an arc between the set of contacts 18 in a direction generally toward such close proximity, the transverse extension 72 of the end insulator 48 extends around the transition between the elongated portion 54 and the transverse portion 60 of the line conductor 12, and additionally extends along at least a portion of transverse portion 60. The end insulator 48 has good dielectric properties even after burning, and it therefore insulates, i.e., resists formation of an arc between, the line conductor 12 and the movable arm 26.

It is noted that an arc causes the end and side insulators 48 and 52 to generate the aforementioned hydrogen gas due to vaporization of the material of the end and side insulators 48 and 52, i.e., an ablation of the material of the end and side insulators 48 and 52 occurs. It is understood that the quantity of material ablated in the production of hydrogen is relatively small when compared with the mass of the end and side insulators 48 and 52. The end and side insulators 48 and 52 may be configured to include a sufficient quantity of ablatable material that sufficient material will exist throughout the life cycle of the circuit breaker 4.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a first conductor comprising an elongated portion;

a second conductor comprising a movable arm;

a set of contacts comprising at least a first stationary contact and at least a first movable contact, the at least a first movable contact and the at least a first stationary contact being separable to interrupt a circuit that includes the first and second conductors;

the at least a first stationary contact being disposed on the first conductor;

the at least a first movable contact being disposed on the movable arm;

an arc extinction system comprising at least a first insulator disposed adjacent the at least a first stationary contact, the at least a first insulator being structured to output a gas upon an initiation of an arc between the at least a first stationary contact and the at least a first movable contact to resist movement of the arc in a direction generally toward the at least a first insulator; and the elongated portion extending adjacent at least a portion of the movable arm to form a reverse loop with the at least a portion of the movable arm, at least a portion of the at least a first insulator being disposed between at least a portion of the elongated portion of the first conductor and the at least a portion of the movable arm.

2. The circuit breaker of claim 1 wherein the arc extinction system includes a second insulator and a third insulators, the second insulator being structured to output a gas upon an initiation of an arc between the at least a first stationary contact and the at least a first movable contact to resist movement of the arc in a direction generally toward the second insulator, the third insulator being structured to output a gas upon an initiation of an arc between the at least a first stationary contact and the at least a first movable contact to resist movement of the arc in a direction generally toward the third insulator, the second and third insulators being disposed at alternate sides of the elongated portion.

3. The circuit breaker of claim 2 wherein the second and third insulators are disposed adjacent and at alternate sides of the at least a first stationary contact.

4. The circuit breaker of claim 1 wherein the first conductor includes a transverse portion that is connected with the elongated portion and extends in a direction transverse thereto, the at least a first insulator extending along at least a portion of the elongated portion and along at least a portion of the transverse portion.

5. A circuit breaker comprising:

a first conductor;

a second conductor comprising a movable arm;

a set of contacts comprising at least a first stationary contact and at least a first movable contacts, the at least a first movable contact and the at least a first stationary contact being separable to interrupt a circuit that includes the first and second conductors;

the at least a first stationary contact being disposed on the first conductor;

the at least a first movable contact being disposed on the movable arm;

an arc extinction system comprising an arc chute and at least a first insulator;

the at least a first insulator being disposed adjacent the at least a first stationary contact and being structured to output a gas upon an initiation of an arc between the at least a first stationary contact and the at least a first movable contact to resist movement of the arc in a direction generally toward the at least a first insulator; and at least a portion of the at least a first stationary contact being disposed generally between at least a portion of the at least a first insulator and at least a portion of the arc chute.

6. The circuit breaker of claim 5 wherein the arc chute, the at least a first stationary contact, and the at least a first insulator are disposed along a main axis of the circuit breaker, and wherein the arc extinction system includes a second insulator and a third insulators, the second insulator being structured to output a gas upon an initiation of an arc between the at least a first stationary contact and the at least a first movable contact to resist movement of the arc in a direction generally toward the second insulator, the third insulator being structured to output a gas upon an initiation of an arc between the at least a first stationary contact and the at least a first movable contact to resist movement of the arc in a direction generally toward the third insulator, the second and third insulators being disposed at alternate sides of the main axis.

7. The circuit breaker of claim 6 wherein the second and third insulators are disposed adjacent and at alternate sides of the at least a first stationary contact.

8. The circuit breaker of claim 7 wherein the at least a first insulator extends between the second and third insulators.

9. The circuit breaker of claim 8 wherein the second and third insulators each include a receptacle, the at least a first insulator being engaged with the second insulator at the receptacle thereof, the at least a first insulator being engaged with the third insulator at the receptacle thereof.

10. The circuit breaker of claim 6 wherein the at least a first movable contact is movable in a first direction away from the at least a first stationary contact, at least a portion of the second insulator and at least a portion of the third insulator each being elongated and extending generally in the first direction away from the at least a first stationary contact.

11. A circuit breaker comprising:

a first conductor;

a second conductor comprising a movable arm;

a set of contacts comprising at least a first stationary contact and at least a first movable contact, the at least a first movable contact and the at least a first stationary contact being separable to interrupt a circuit that includes the first and second conductors;

the at least a first stationary contact being disposed on the first conductor;

the at least a first movable contact being disposed on the movable arm; and an arc extinction system comprising a first insulator and a second insulator disposed adjacent and at alternate sides of the at least a first stationary contact, the first insulator being structured to output a gas upon an initiation of an arc between the at least a first stationary contact and the at least a first movable contact to resist movement of the arc in a direction generally toward the first insulator, the second insulator being structured to output a gas upon an initiation of an arc between the at least a first stationary contact and the at least a first movable contact to resist movement of the arc in a direction generally toward the second insulator; and wherein the first conductor includes a first outwardly-protruding boss and a second outwardly-protruding boss, and wherein the first and second insulators each include a recessed region, the first outwardly-protruding boss being engaged with the recessed region of the first insulator, the second outwardly-protruding boss being engaged with the recessed region of the second insulator.

12. A circuit breaker comprising:

a first conductor;

a second conductor comprising a movable arm;

a set of contacts comprising at least a first stationary contact and at least a first movable contact, the at least a first movable contact and the at least a first stationary contact being separable to interrupt a circuit that includes the first and second conductors;

the at least a first stationary contact being disposed on the first conductor;

the at least a first movable contact being disposed on the movable arm; and an arc extinction system comprising a first insulator and a second insulator disposed adjacent and at alternate sides of the at least a first stationary contact, the first insulator being structured to output a gas upon an initiation of an arc between the at least a first stationary contact and the at least a first movable contact to resist movement of the arc in a direction generally toward the first insulator, the second insulator being structured to output a gas upon an initiation of an arc between the at least a first stationary contact and the at least a first movable contact to resist movement of the arc in a direction generally toward the second insulator; and wherein the arc extinction system includes a third insulator disposed adjacent the at least a first stationary contact, the third insulator being structured to output a gas upon an initiation of an arc between the at least a first stationary contact and the at least a first movable contact to resist movement of the arc in a direction generally toward the third insulator.

13. The circuit breaker of claim 12 wherein the third insulator extends between the first and second insulators.

14. The circuit breaker of claim 13 wherein the at least first and second insulators each include a receptacle, the third insulator being engaged with the first insulator at the receptacle thereof, the third insulator being engaged with the second insulator at the receptacle thereof.

* * * * *